United States Patent [19]

Snyder

[11] Patent Number: 4,657,302

[45] Date of Patent: Apr. 14, 1987

[54] LOUNGE CONSTRUCTION

[75] Inventor: Bobbie L. Snyder, Grandview, Mo.

[73] Assignee: Fixtures Manufacturing Corporation, Kansas City, Mo.

[21] Appl. No.: 710,589

[22] Filed: Mar. 11, 1985

[51] Int. Cl.[4] ..... A47C 15/00

[52] U.S. Cl. ..... 297/232; 297/440; 108/64; 108/153

[58] Field of Search ..... 297/232, 440, 442, 443, 297/248, 250, 233; 108/64, 114, 153, 59, 155, 157, 156

[56] References Cited

U.S. PATENT DOCUMENTS

| | | | |
|---|---|---|---|
| 1,520,518 | 12/1924 | Thomason | 108/64 |
| 2,654,487 | 10/1953 | Degener | 108/153 X |
| 2,737,430 | 3/1956 | Ess | 108/64 |
| 2,746,525 | 5/1956 | Cooper | 297/440 X |
| 3,024,066 | 3/1962 | Anderson et al. | 297/248 |
| 3,041,107 | 6/1962 | Schaefer | 297/248 |
| 3,199,470 | 8/1965 | Good | 108/64 |
| 3,241,885 | 3/1966 | Deaton | 108/64 X |
| 3,261,640 | 7/1966 | Straits . | |
| 3,328,075 | 6/1967 | Albinson . | |
| 3,494,662 | 2/1970 | Schaefer et al. . | |
| 3,521,579 | 7/1970 | Stafford | 108/64 |
| 3,528,096 | 9/1970 | Moberg | 297/130 |
| 3,568,967 | 3/1971 | Furtak . | |
| 3,638,997 | 2/1972 | Shapiro et al. . | |
| 3,672,723 | 6/1972 | Decursu et al. | 297/440 |
| 3,885,766 | 5/1975 | Lesch et al. . | |
| 3,990,741 | 11/1976 | Snyder et al. . | |
| 4,265,483 | 5/1981 | Laferty et al. . | |

FOREIGN PATENT DOCUMENTS

| | | | |
|---|---|---|---|
| 7506379 | 12/1975 | Netherlands | 297/440 |
| WO79/00074 | 2/1979 | PCT Int'l Appl. | 297/440 |
| 470860 | 5/1969 | Switzerland | 108/153 |

*Primary Examiner*—Kenneth J. Dorner
*Assistant Examiner*—Laurie K. Cranmer
*Attorney, Agent, or Firm*—Litman, Day & McMahon

[57] ABSTRACT

A lounge construction is disclosed for grouping a plurality of furniture units, such as chairs, together. The chairs or other furniture units have frames supported by a plurality of generally vertical leg posts, which extend laterally of either side of the frame. A central lounge frame is included for connecting two furniture units, and the lounge frame is adapted to receive one of several types of furniture pieces, including a table top or chair seat and back. The central lounge frame has a support structure with front and rear transverse members connected by a crossbrace. A socket is attached at each end of the respective transverse members, and each socket receives an upper end of one of the leg posts whereby the central frame shares the inner legs of the neighboring furniture units. Each of the sockets has a slot therein which is aligned with a transverse support member of the furniture unit when the central frame is in place. The slots are arranged on each socket to accommodate the transverse support members of the furniture unit and to properly position the central lounge frame. The slots extend along a portion of the length of the socket so that the vertical positioning of the central lounge frame is also controlled.

9 Claims, 8 Drawing Figures

Fig. 6.
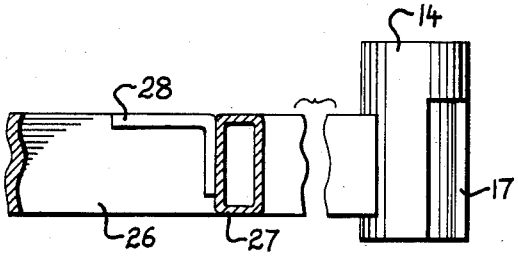
Fig. 7.
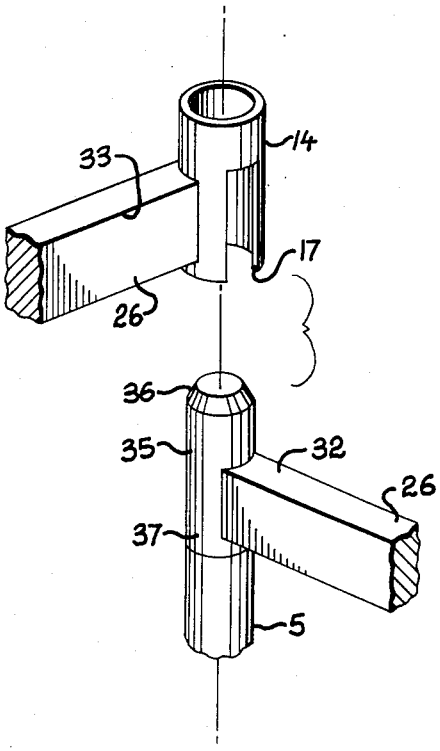
Fig. 5.
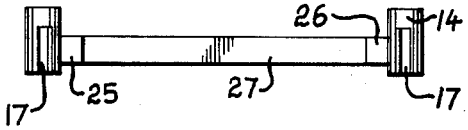
Fig. 3.
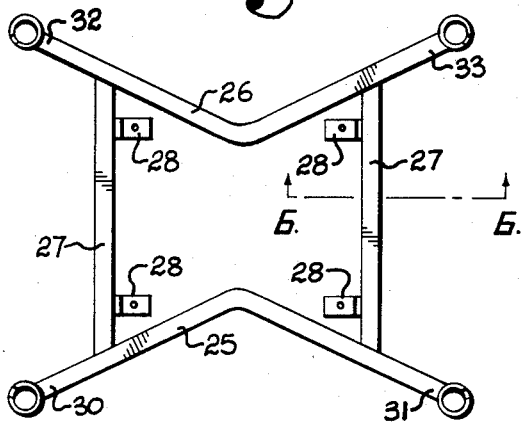
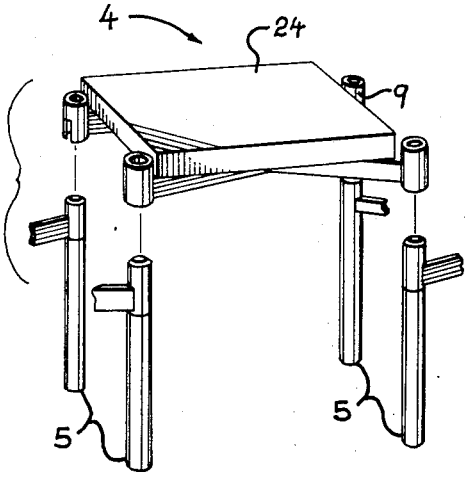
Fig. 4.
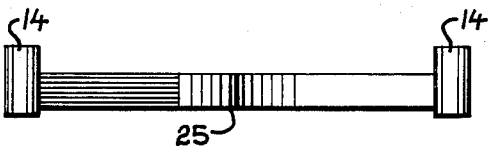
Fig. 8.

LOUNGE CONSTRUCTION

BACKGROUND OF THE INVENTION

The present invention relates to modular furniture units and particularly to modular lounge constructions including chairs and the like connected together by modular frame structures.

Tandem chair constructions have long been used in structured seating arrangements, such as waiting areas and conference rooms. Typically, these structured configurations have been assembled by means of various ganging devices, which either permanently or temporarily connect a row of chairs together. However, these units generally combine only chair members and do not accommodate table units or the like.

Additionally, many traditional ganging units are obtrusive and do not blend well into the chair design scheme. This problem has been accentuated by recent emphasis on ergometric designs which blend function and aesthetics.

OBJECTS OF THE INVENTION

The principle objects of the present invention are: to provide a lounge construction including various furniture units formed into a functional furniture arrangement; to provide such a construction in which standard modular chairs are utilized in conjunction with a mounting structure; to provide such a construction in which the mounting structure connects adjacent chairs and supports a selected furniture member; to provide such a construction in which the chairs have outwardly projecting vertical leg posts adapted to receive the mounting structure; to provide such a construction wherein the mounting structure has terminal sockets for receiving the vertical leg posts and slots therein for accommodating a transverse support member of the chair; to provide such a construction which results in an attractive modular furniture unit which is economical to manufacture, durable in construction, and particularly well adapted for the proposed use.

Other objects and advantages of this invention will become apparent from the following description taken in conjunction with the accompanying drawings wherein are set forth, by way of illustration and example, certain embodiments of this invention.

SUMMARY OF THE INVENTION

A lounge construction according to the present invention includes at least two furniture units, most commonly chairs. The chairs are connected by a central or modular lounge frame to form the lounge construction. The chairs and central lounge frame are designed so that several chairs can be grouped together to form various functional and aesthetically pleasing furniture groupings. The chairs or other furniture units have frames that are supported by four spaced leg posts. The leg posts extend laterally of either side of the frame such that a chair seat or other furniture unit is supported on the frame between the leg posts.

The central lounge frame has a support structure that receives one of several types of furniture pieces, for example, a table top or another chair seat. Preferably, the central lounge frame has a support structure with front and rear transverse members connected by at least one crossbrace, and the support structure carries the furniture unit. In the preferred embodiment, there are inner and outer pairs of leg posts, each of the pairs having a front leg post and a rear leg post. A socket is attached at each end of the front and rear transverse members, in a corresponding relationship to the front to rear spacing of pairs of inner leg posts on the furniture units. The sockets are tubular housings that fit over a top portion of the corresponding inner leg post to connect the two furniture units.

Each socket has a slot which extends partially along the length of the socket and is sized to receive one of the front and rear transverse members, as the case may be. The engagement of the slot with a terminal end of the front and rear transverse members provides a locking arrangement whereby the vertical position of the central lounge frame is determined by the cooperation between the height of the transverse members and the length of the slot. Preferably, the transverse members and the slots are arranged such that the vertical positioning of the central lounge frame is coplanar with the furniture unit frames. The locking arrangement also stabilizes the lounge construction from lateral sway.

When the central lounge frame is in position, it shares the inner leg posts of the two furniture units such that three furniture units are supported by a total of just four pairs of leg posts and a lounge construction is defined.

The drawings constitute a part of this specification and include exemplary embodiments of the present invention and illustrate various objects and features thereof.

BRIEF DESCRIPTION OF THE DRAWINGS

FIG. 3 is an enlarged, bottom plan view of the central lounge frame.

FIG. 4 is an enlarged, front elevational view of the central lounge frame.

FIG. 5 is an enlarged, side elevational view of the central lounge frame.

FIG. 6 is an enlarged, cross-sectional view taken along line 6—6, FIG. 3, with the structure shown in its front elevational position.

FIG. 7 is an enlarged, fragmentary exploded view of a tubular housing of the central lounge frame in position over a portion of the vertical leg post of a chair unit.

FIG. 8 is a fragmentary, perspective view of the central lounge frame in an elevated position over adjacent leg posts and showing a table unit attached to the central lounge frame.

DETAILED DESCRIPTION OF THE PRESENT INVENTION

Figure 1:
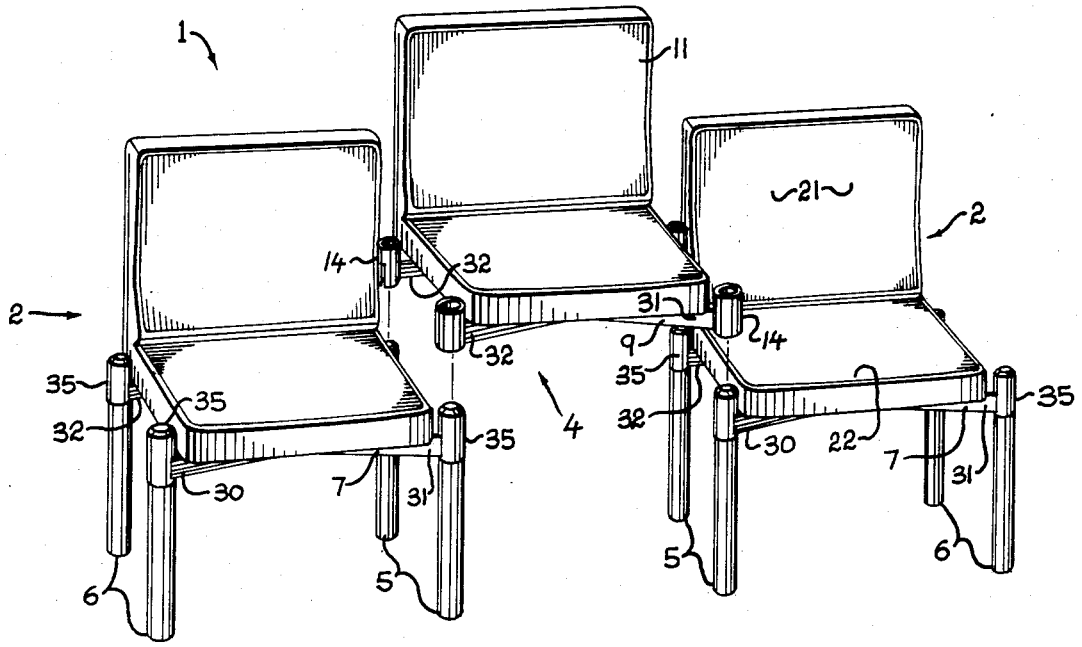
FIG. 1 is a perspective view of the lounge construction of the present invention showing a central or modular lounge frame with a selected seat furniture unit in an elevated position to demonstrate how the units are connected.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally indicates a lounge construction comprising a plurality of furniture units 2. A central or modular lounge frame 4 connects two adjacent furniture units 2 to form the lounge construction 1.

Figure 2:
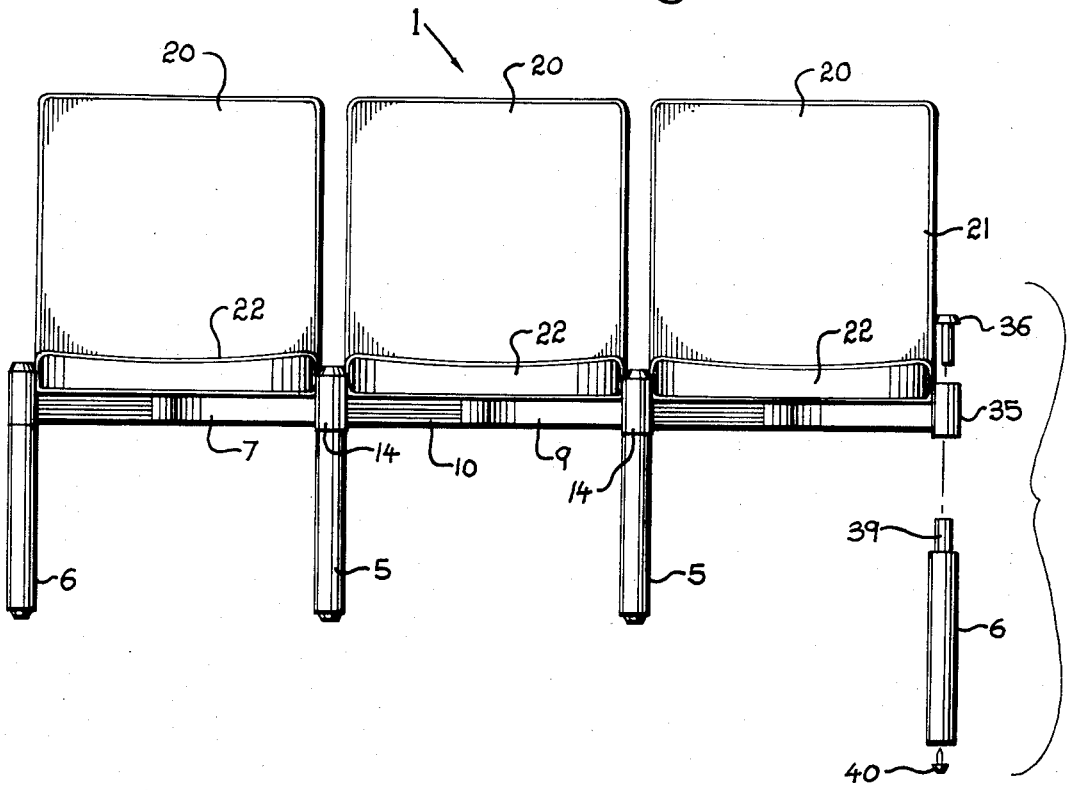
FIG. 2 is a front elevational view of the chair units and central lounge frame of the present invention showing the central lounge frame in position and showing a vertical leg post in an exploded view.

The furniture units 2 include a plurality of generally upright leg posts, specifically an inner pair 5 and an outer pair 6 of leg posts. Referring to FIG. 2, inner pairs 5 of neighboring furniture units 2 are spaced apart a predetermined distance.

The central lounge frame 4 has a support structure 9 which includes a support member 10 for receiving and supporting a selected furniture module 11. Attached to opposite ends of the support member 10 are sockets 14 that are received over upper ends of the leg posts 6. The sockets 14 have means for engaging a portion of the furniture frame 7 to accommodate receipt of the leg post 6 into the socket 14. As illustrated, the engaging means comprise a slot 17 in the socket 14 that slips over a portion of the furniture frame 7.

The lounge construction 1 is adapted to be assembled in a plurality of different configurations to adapt to a changing room layout. As shown, the furniture units 2 comprise two chair units 20 which have a back portion 21 and a seat portion 22 which is attached to the furniture frame 7. It is foreseen that various other furniture units 2 could be attached to the furniture frame 7, such as a table structure or the like. A similar chair unit 20 may constitute the furniture module 11 of the lounge frame 4, although it is also envisioned that the furniture module 11 may comprise a table structure 24 or the like. As seen in FIG. 8, the table structure 24 is attached to the support structure 9, in substitution for the chair unit 20 shown in FIG. 1.

The furniture frame 7 and support structure 9 are similar in construction. They include front and rear transverse or convergent members 25 and 26 connected by crossbraces 27 as seen in FIG. 3. A plurality of tabs 28 are attached to the crossbraces 27 and are used for securing the various furniture units 2 and furniture modules 11 to the respective furniture frame 7 and support structure 9. Each convergent member 25 and 26 has respective first and second laterally spaced terminal ends 30, 31, 32 and 33.

One of the sockets 14 is attached to each of the terminal ends of the support structure 9. A corresponding rod member 35 is attached to each convergent member terminal end of the furniture frame 7. The rod members 35 are sized to be telescopically receivable relative to the sockets 14. As illustrated, the rod members 35 are slightly smaller in diameter than the inner diameter of the socket 14. It is envisioned, however, that the reverse could be true such that the orientations of the sockets 14 and rod members 35 could be switched whereby modified rod members (not shown) would be attached to convergent members of the support member while modified sockets (not shown) are attached to the furniture frame, with corresponding changes in the slot 17.

An upper end 36 of each rod member 35 is frustoconical to facilitate receipt of the rod member 35 into the socket 14. A lower end 37 of each rod member 35 is hollow to receive an upper end 39 of the leg posts 5, 6. As seen in FIG. 2, the upper end 36 of rod member 35 may be a separate pegged piece which extends through the body of the rod member 35 into the leg post upper end 39 as used to securely connect the leg posts 5, 6 to the rod member 35. A glide 40 is attached to the bottom of the leg post 6.

The sockets 14 are illustrated as tubular housings that define central bores attached to the front and rear convergent member terminal ends 30, 31, 32 and 33 and opposed sockets (housings) are spaced apart the same predetermined distance that the furniture units 2 are spaced apart. The housings are illustrated as being hollow, tubular members for receipt of the leg post upper ends 39. The slots 17 are cut into the sockets 14 at a position so that a corresponding convergent member 25, 26 can be received therein as seen in FIGS. 3 and 7. The slots are positioned to receive the front or rear convergent member 25, 26 as the case may be; thus as seen in FIGS. 3 and 5, the relative positions of the slots 17 on the front and rear sockets 14 are different.

In use, as seen in FIG. 1, the central lounge frame 4 is positioned over inner leg posts 5 of neighboring furniture units 2, in this case, chair units 20. As seen in FIG. 2, the leg post upper ends 39 are received in respective housing sockets 15, thus forming the lounge construction 1.

Specifically, sockets 14 associated with the front and rear first terminal ends 30 and 32 of the support structure 9 are positioned over respective inner leg posts 5 of one of the furniture units 2. Correspondingly, sockets 14 associated with the front and rear second terminal ends 31 and 33 are positioned over the respective inner leg posts 5 of the other neighboring furniture unit 2.

The lateral spacing of the leg posts is such that they extend beyond the sides of the furniture units 2, e.g. the seat portion 22 or table structure 24, and allow the central lounge frame 4 to be easily placed in position.

The partial slot 17 is sized and positioned to correspond to the support member, specifically a convergent member 25, 26, that is to be received therein. As seen in FIG. 3, the relative positions of the slots 17 in the different sockets 14 vary, in accordance with the relative positions of the convergent members to be received. The first and second pairs of sockets thus complement second and first pairs of rod members 35 to define a stable lounge construction when the modular lounge frame 4 is in position, as seen in FIG. 2.

The cooperation of the slot 17 and transverse members 25, 26 forms a locking arrangement to yield a stable lounge construction. The length of the slot 17 determines the relative vertical position of the central lounge frame 4 to the furniture frame 7 because it limits the downward movement of the central lounge frame as it is positioned relative to the transverse member it contacts. Preferably, the central lounge frame 4 is horizontally aligned with the furniture frame 7, but this is not required. Also, the locking arrangement stabilizes the lounge construction by reducing or eliminating lateral sway of the individual units relative to one another.

It is to be understood that while certain forms of the present invention have been illustrated and described herein, it is not to be limited to the specific forms or arrangement of parts described and shown.

What is claimed and desired to be secured by Letters Patent is as follows:

1. A furniture construction comprising:

(a) a central frame and two laterally spaced furniture units, each of said furniture units having a frame with supporting outer and inner leg posts, said inner leg posts having an upper portion;

(b) said central frame comprising a support structure for supporting a furniture module and a plurality of terminal members attached to said support structure, said terminal members being spaced apart in a fixed pattern;

(c) said inner leg post upper portions forming a pattern corresponding to said terminal member pattern; and (d) said terminal members being vertically disposed sockets coaxially receiving said upper portions upwardly thereinto for support of said central frame, thereby simultaneously linking said furniture units by said central frame and providing vertical support for said central frame by said furniture units.

2. The furniture construction as set forth in claim 1, wherein:

(a) said spaced furniture units are chairs.

3. The furniture construction as set forth in claim 1, including:

(a) a chair seat on said central frame.

4. The furniture construction as set forth in claim 1, including:

(a) a tabletop on said central frame.

5. The furniture construction as set forth in claim 1 wherein:

(a) said sockets include means for engaging a portion of said furniture unit frames to form a locking arrangement between said central frame and said furniture unit frames.

6. The furniture construction as set forth in claim 5, wherein:

(a) said means for engaging a portion of said furniture unit frames comprise vertically extending slots directed upwardly into the wall of said sockets and positioned to receive a portion of one of said furniture unit frames.

7. The furniture construction as set forth in claim 1, wherein:

(a) said sockets comprise cylindrical housings.

8. The furniture construction as set forth in claim 1, wherein:

(a) said inner leg post upper portions are coaxial with respective inner leg posts.

9. A furniture construction comprising:

(a) a central frame and two laterally spaced furniture units, each of said furniture units having a frame with supporting outer and inner leg posts, said inner leg posts having an uppr portion;

(b) said central frame comprising a support structure for supporting a furniture module and a plurality of terminal members attached to said support structure, said terminal members being spaced apart in a fixed pattern;

(c) said inner leg post upper portions forming a pattern corresponding to said terminal member pattern; and (d) each of said terminal members being generally vertically disposed and having one of a socket and a post; each of said inner leg post upper portions being generally vertically disposed and having the other of said socket and said post, said sockets coaxially receiving corresponding posts thereinto for support of said central frame, thereby simultaneously linking said furniture units by said central frame and providing vertical support for said furniture units.

* * * * *